US007810570B2

(12) United States Patent
Collins et al.

(10) Patent No.: US 7,810,570 B2
(45) Date of Patent: Oct. 12, 2010

(54) SHOCK-RELEASE FLUID FRACTURING METHOD AND APPARATUS

(75) Inventors: James Collins, Calgary (CA); Mark T. Andreychuk, Calgary (CA)

(73) Assignee: Calfrac Well Services Ltd., Calgary (CA)

( * ) Notice: Subject to any disclaimer, the term of this patent is extended or adjusted under 35 U.S.C. 154(b) by 353 days.

(21) Appl. No.: 11/552,889

(22) Filed: Oct. 25, 2006

(65) Prior Publication Data

US 2007/0295508 A1 Dec. 27, 2007

(51) Int. Cl.
*E21B 43/26* (2006.01)

(52) U.S. Cl. ..... 166/308.1; 166/177.5

(58) Field of Classification Search ..... 166/305.1, 166/308.1, 373, 177.4, 177.5
See application file for complete search history.

(56) References Cited

U.S. PATENT DOCUMENTS

| | | | | |
|---|---|---|---|---|
| 3,200,882 | A * | 8/1965 | Allen | 166/308.1 |
| 3,255,820 | A * | 6/1966 | Brandon | 166/249 |
| 3,589,442 | A * | 6/1971 | Kilgore | 166/63 |
| 4,270,569 | A * | 6/1981 | Reay et al. | 137/514.7 |
| 4,993,491 | A | 2/1991 | Palmer et al. | |
| 5,836,393 | A * | 11/1998 | Johnson | 166/308.1 |
| 6,533,035 | B2 * | 3/2003 | Troutt et al. | 166/249 |
| 2004/0159434 | A1 | 8/2004 | Johnson et al. | |

FOREIGN PATENT DOCUMENTS

| | | |
|---|---|---|
| CA | 2504300 | 10/2005 |

OTHER PUBLICATIONS www.swtorpedo.com/RMOTC.Itml ; Field test of SWTORPEDO (Shock Wave Torpedo) as an explosive method based on effect of rock dilitancy to increase productivity/injectivity for oil and gas wells; Igor Skavovsky; Aug. 13, 2004.

USGS Coal-Bed Methane:Potential and Concerns; US Department of the Interior, US Geological Survey; USGS Fact Sheet FS-123-00 Oct. 2000.

www.ags.gov.ab.ca/activities/CBM/coal_and_cbm_intro2.html ; EUB Alberta Energy and Utilities Board; Alberta Geological Survey; Coal Maturation and Coalbed Methane (CBM) Generation; last modified 2005.

www.connect.slb.com; Schlumberger Completion/Stimulation for Calbed Methane—optimizing production from coalbed methane reservoirs; Sep. 2001.

* cited by examiner

*Primary Examiner*—Kenneth Thompson
*Assistant Examiner*—David Andrews
(74) *Attorney, Agent, or Firm*—Sean W Goodwin

(57) ABSTRACT

A shock tool is adapted to a bottom hole tool assembly for isolating a zone in a subterranean formation accessed by a wellbore. Fracturing fluid such as nitrogen is accumulated at fracturing pressures uphole of the shock tool for subsequent and rapid release to the formation. The tool assembly can be suspended from a conveyance string in which fluid is accumulated for shock release through a valve of the shock tool and through an injection tool to the zone isolated by the injection tool. After a first zone is shocked, the tool assembly can be moved to a new zone, or multiple shocks can be applied cyclically at the selected zone.

13 Claims, 12 Drawing Sheets

SHOCK-RELEASE FLUID FRACTURING METHOD AND APPARATUS

FIELD OF THE INVENTION

The invention relates to method and apparatus for improving the extent of fracturing of formations using a shock release of fracturing fluid.

BACKGROUND OF THE INVENTION

Conventional fluid fracturing of subterranean formations comprises positioning a tool in a cased wellbore traversing a zone to be fractured. The tool straddles perforations in the cased wellbore. Fluid is pumped down a tubular conduit from surface to the subterranean tool at a flow rate and pressure sufficient to hydraulically fracture the formation.

The exact nature of the resulting fractures is not fully known and will vary for different formations. As set forth in U.S. Pat. No. 4,995,463 to Kramm et al., issued in 1991, the fracture mechanics and fluid flow behaviour in cleated, coal bed formations is substantially different that those in sandstone and the like which are more conventionally known for oil and gas operations.

SUMMARY OF THE INVENTION

A known method for hydraulically fracturing formations comprises exposing the formation to gradually greater and greater hydraulic pressures until either the extent of fracturing is achieved or the losses through developed fractures exceeds the rate of fluid injection. It is believed that some formations are less effectively fractured using such known processes.

In one aspect of the invention a shock tool is provided comprising a valve adapted to a bottom hole tool assembly for accumulating fracturing fluid at fracturing pressures uphole of the tool for subsequent and rapid release to the formation. This apparatus is well suited for a novel fracturing methodology wherein the valve opens suddenly for maximum shock to the formation. Coal bed methane seams of formations can be particularly well suited to such a fluid hammer or shock fracturing methodology. After a first zone is shocked, the tool can be moved to a new zone, or multiple shocks can be applied cyclically at the selected zone.

In one broad aspect of the invention, a method for fracturing subterranean formations penetrated by a wellbore comprises isolating a zone in the subterranean formation, accumulating a fracturing fluid, such as a gas, to a threshold pressure and isolated from the formation, and releasing the fracturing fluid to communicate with the isolated zone to shock fracture the formation. One approach is to access the formation with a conveyance string extending downhole through the wellbore for conveying a tool to the formation; isolating the zone with the tool, the tool having an uphole seal and a downhole seal spaced uphole and downhole of the isolated zone; and closing the conveyance string at the tool for accumulating the fracturing fluid at the threshold pressure in the conveyance string; and opening the bore of the conveyance string at the tool for releasing the fracturing fluid through a port in the tool to communicate with the isolated zone to shock fracture the formation.

One broad form of apparatus for achieving one methodology of the invention comprises providing a tool assembly for shock fracturing a subterranean formation penetrated by a wellbore, the tool assembly positioned downhole in the wellbore at a position adjacent the formation and forming an annulus therebetween which is in fluid communication with the formation, the tool assembly comprising: an injection tool having an uphole seal and a downhole seal adapted for isolating the annulus uphole and downhole of a zone in the formation, an injection bore at an inlet end uphole of the uphole seal, and an injection port communicating between the bore and the isolated zone; and a shock tool having an inlet and a bore in communication with the injection bore, the shock tool bore having a valve fit to the inlet, wherein when the valve is closed, fracturing fluid is accumulated uphole of the inlet at a fluid pressure, and when the valve is opened, the accumulated fracturing fluid is released through the shock tool to the injection port for shock fracturing the formation.

In one embodiment of the shock tool, the valve is biased to close when the fluid is at a resetting pressure and the valve can further comprise a poppet for triggering opening of the valve, the poppet being pressure-actuable at the threshold pressure.

DETAILED DESCRIPTION OF THE PREFERRED EMBODIMENTS

Figure 1A:
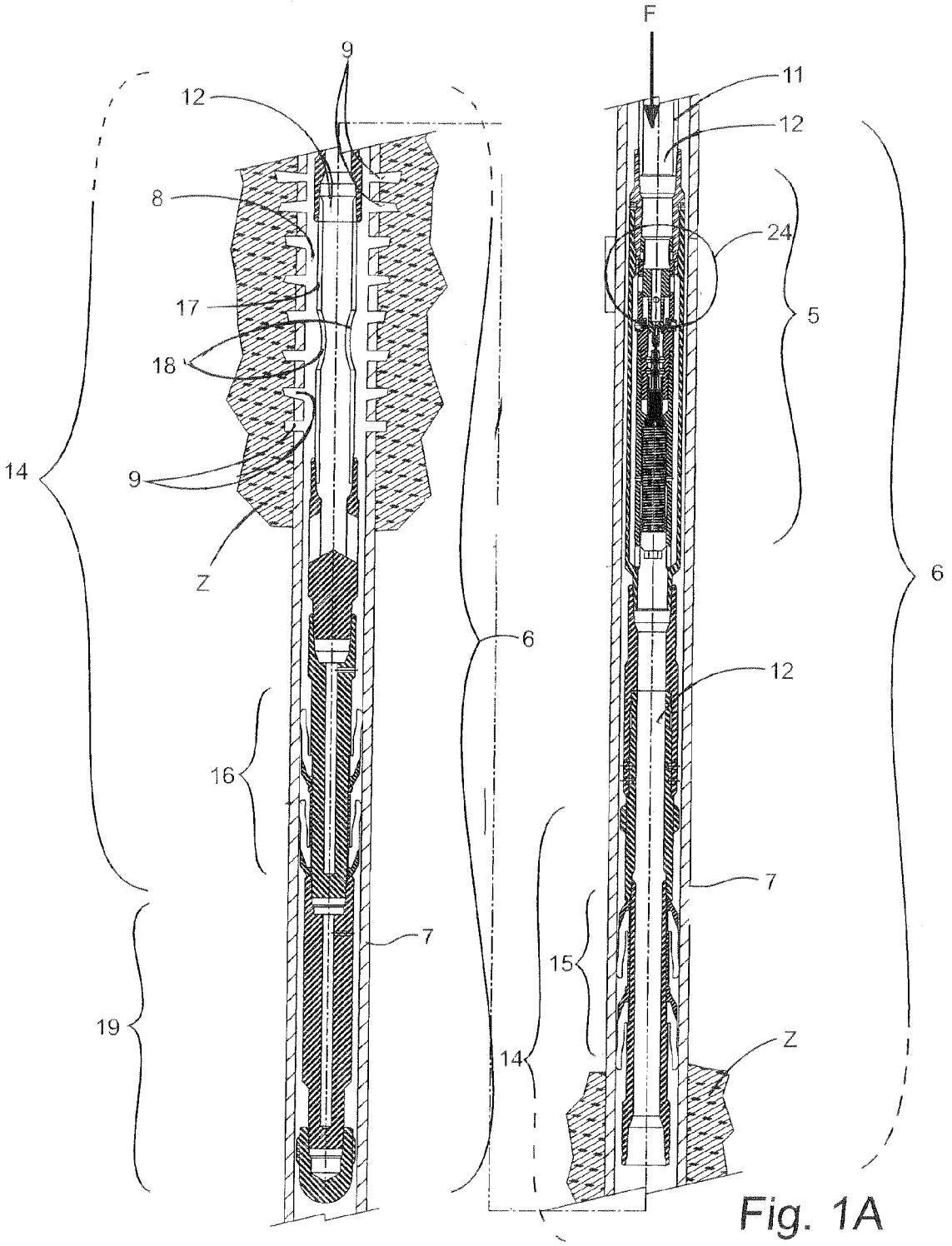
FIG. 1A illustrates a tool assembly for location at a subterranean formation and incorporating an embodiment of a shock tool of the present invention.

With reference to FIG. 1A, a shock tool 5 is provided for fracturing subterranean formations Z penetrated by a wellbore (context not shown). In an embodiment of the invention, the shock tool 5 is part of a tool assembly 6 conveyed downhole for actuation in the wellbore, preferably a wellbore having casing 7.

The tool assembly is lowered downhole into the casing 7 on a conveyance string 11 such as on wireline, jointed tubulars or coiled tubing. The shock tool is positioned in the vicinity of the formation Z.

As is conventional in fracturing formations, a zone is isolated in the formation Z and an annulus 8 is formed between the tool assembly 6 and the wellbore. The annulus 8 is in communication with the isolated zone in the formation, such as through perforations 9 in the casing 7. Fracturing fluid F is accumulated for sudden release through the shock tool 5.

Figure 1B:
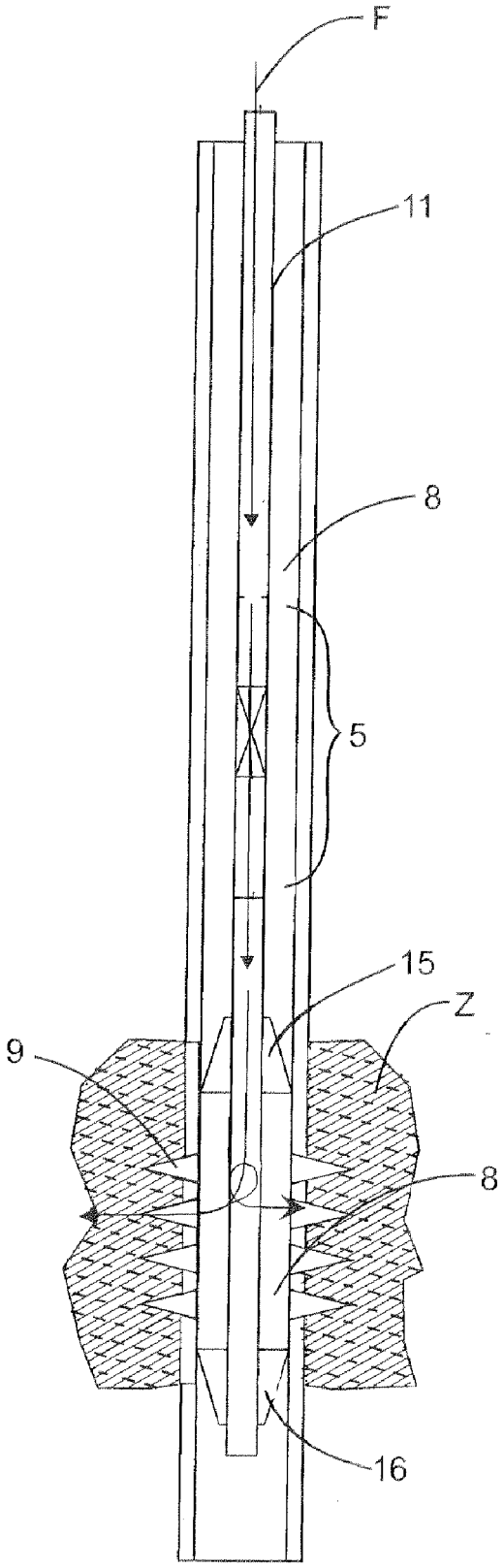
FIGS. 1B and 1C are schematic drawings illustrating an embodiment of a shock tool according to FIG. 1A having fluid accumulated in a conveyance string and another embodiment for the release of fluid accumulated in a cased wellbore.

In one embodiment as shown in FIGS. 1A and 1B, the conveyance string 11 has a bore 12 which is contiguous with a working bore of the shock tool and the fracturing fluid F is accumulated above the shock tool 5 in the contiguous bores 12 of the conveyance string. Fluid suitable for fracturing formations is used and can be selected for the formation as known by those skilled in the art. Compressible fluid contains more releasable energy that non-compressible fluids when compressed. Typically a compressible fluid such as nitrogen gas is accumulated in the conveyance string and, through the operation of the shock tool 5; the fluid is released suddenly at the isolated zone, shock fracturing the formation Z.

A tool assembly 6 comprises a suitable conventional connector means for attaching the tool assembly to the conveyance string such as coiled tubing. In accordance with FIGS. 1A and 1B, generally, the tool assembly 6 is a tubular having a bore 12 for communicating fluid between the string and the tool 5. The tool assembly comprises the shock tool 5 which is supported by the conveyance string, a connection 13 between the shock tool and an isolating tool such as an injection packer 14, and other tool components for enabling tripping and operations of the tool assembly 6.

The isolation tool or injection packer 14 can be of conventional construction and comprises a tubular body having opposing uphole and downhole seals such as packers and sealing elements (compression/tension). As shown in FIG. 1A, one type of injection packer 14 is a straddle packer tool having opposingly oriented, elastomeric uphole cups 15 and downhole cups 16 as sealing elements which separate and retain high pressure fracturing fluid from lower pressures in the annulus 8 above and below the tool assembly 6. The uphole and downhole cups 15,16 are spaced by a pup joint 17. The pup joint 17 has an injection port 18 for fluid communication from the bore 12 to that part of the annulus 8 isolated between the opposing cups 15,16. The injection packer 14 is located with the uphole and downhole cups 15,16 straddling perforations 9 in the casing enabling communication of the fracturing fluid through the injection port 14 and to the formation Z. Typically, a downhole end of the tool assembly 6 can be fit with an instrumentation probe housing and bullnose 19.

Figure 1C:
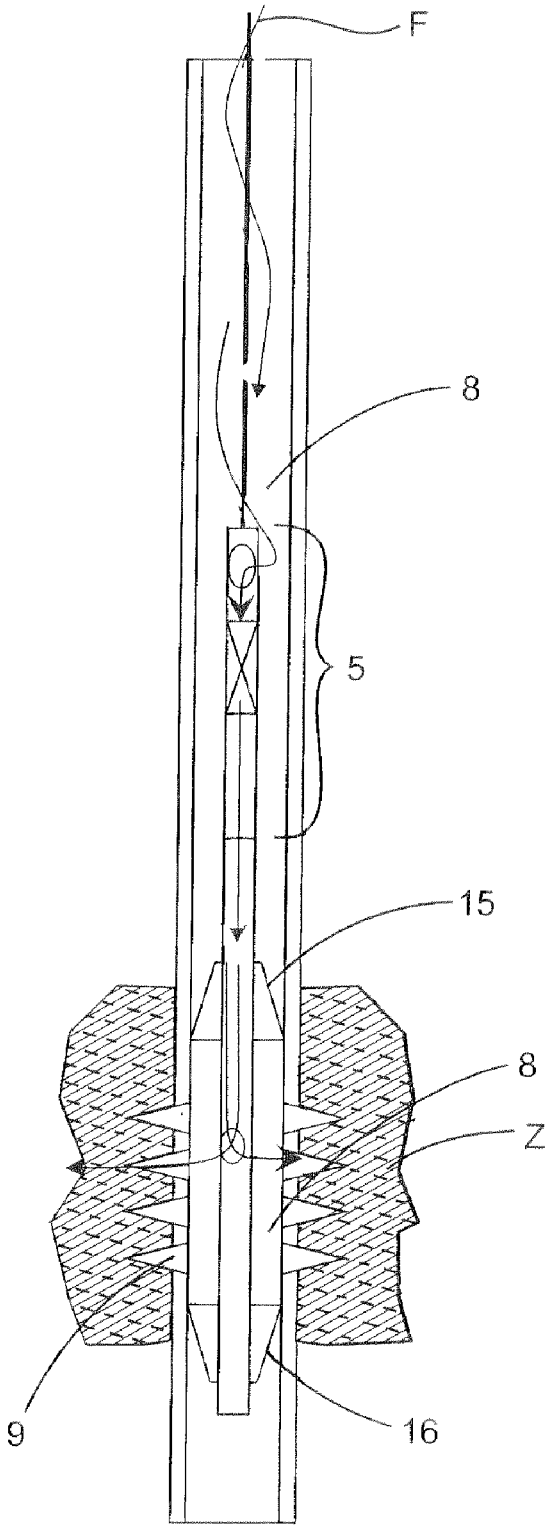

In another embodiment as shown in FIG. 1C, fluid F can be accumulated in a wellbore casing 7 and directed through an uphole inlet in the shock tool 5 for release therethrough to the injection packer 14 and into the isolated zone of the formation Z.

In FIGS. 1A, 1B and 1C, the shock tool 5 comprises a valve 24 for enabling the accumulation of fracturing fluid F to a threshold pressure when closed and for delivering a sudden or shock release of the accumulated fluid through the injection packer's injection port 18 when open. The resulting shock could be deemed equivalent to a water-hammer effect. A large stored energy of the accumulated fluid is released into the formation. The shock tool's valve can be operated by a variety of techniques including pressure, motors and remote triggering tool.

With reference to FIGS. 2-5 and FIGS. 6A-6C, one embodiment that is particularly useful is a poppet-operated shock tool.

Figure 2:
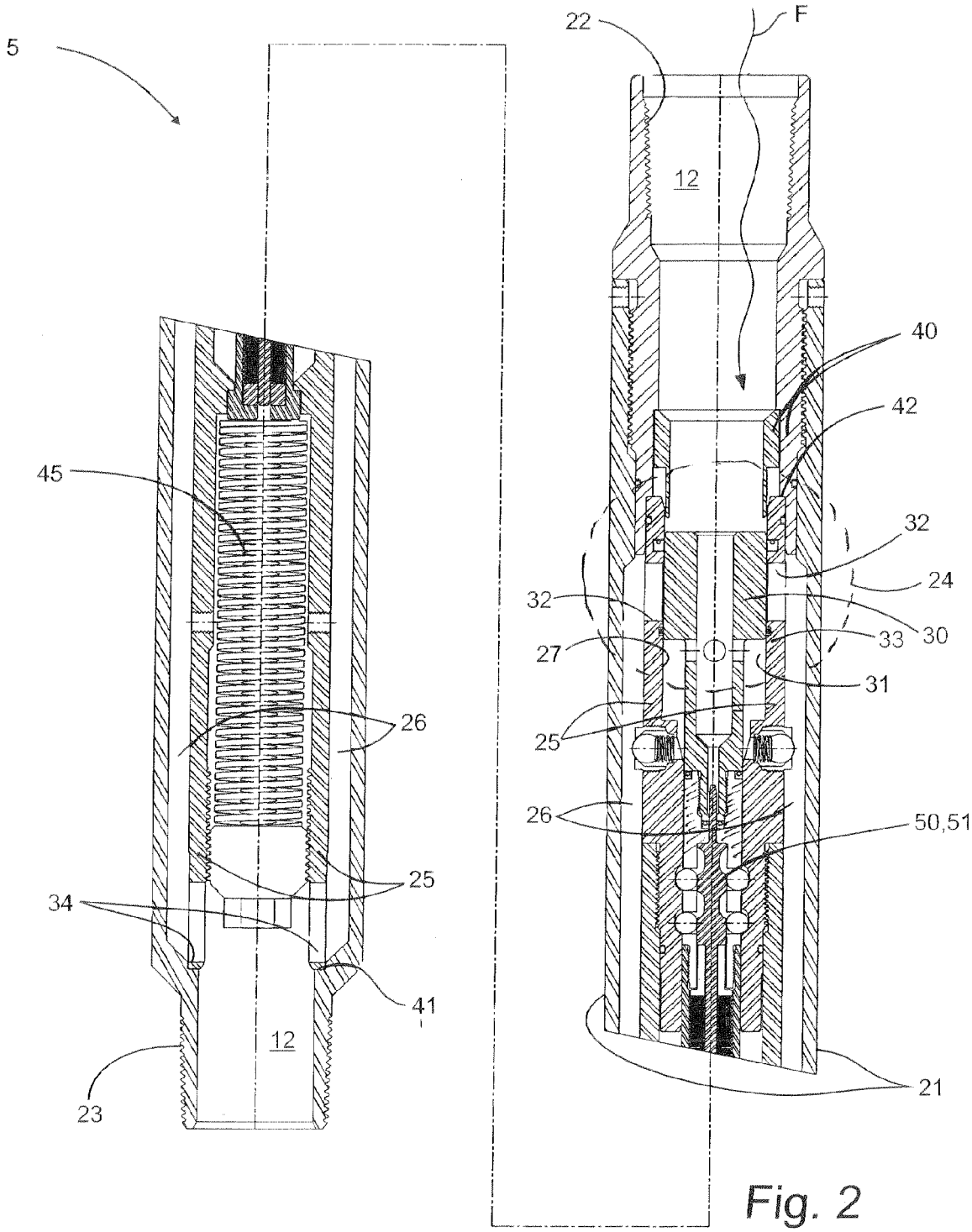
FIG. 2 is a cross-sectional view of an embodiment of the shock tool in the closed position.

With reference to FIG. 2, the shock tool 5 has a tubular body 21 having the working bore 12 connected at an inlet end 22 to a source of fracturing fluid F, such as the conveyance string. The bore 12 of the shock tool 5 is connected at a discharge end 23 for the communication and direction of accumulated fracturing fluid F to the formation, such as through the injection packer 14. The valve 24 is situated in the tubular body 21 and operable to block the fracturing fluid F and to suddenly release the fluid. In an embodiment of the shock tool 5, the tubular body 21 is fit with a sleeve 25 forming a bypass annulus 26 within the tubular body 21 which communicates between the fracturing fluid F at the inlet end 22 and the formation in fluid communication with at the downhole end 23 of the shock tool 5. The sleeve 25 forms a sleeve bore 27 which is fit with the valve 24 for enabling and disabling flow through the bypass annulus 26. With the valve 24 in a closed position (FIG. 2), fracturing fluid F can accumulate to a fracturing pressure in the working bore 12 at the inlet end 22 of the shock tool 5. With the valve 24 in the open position (FIG. 3), fracturing fluid F flows through the bypass annulus 26 to be directed to the formation.

In one embodiment, the valve 24 comprises a main piston 30 movable axially within a piston bore portion 31 of the sleeve bore 27. The main piston 30 is axially movable in the piston bore 31 between the open and closed positions for opening and closing a discharge port respectively. The discharge port or bypass port 32 is formed in an annular wall 33 at an uphole end of the sleeve 25. The sleeve 25 is cylindrical and secured within the tubular body 21 such as with a threaded cylindrical uphole sub 40 which sandwiches the sleeve between a supporting shoulder 41 at the downhole end 23 and a sealing shoulder 42 at an uphole end 43.

Figure 4:
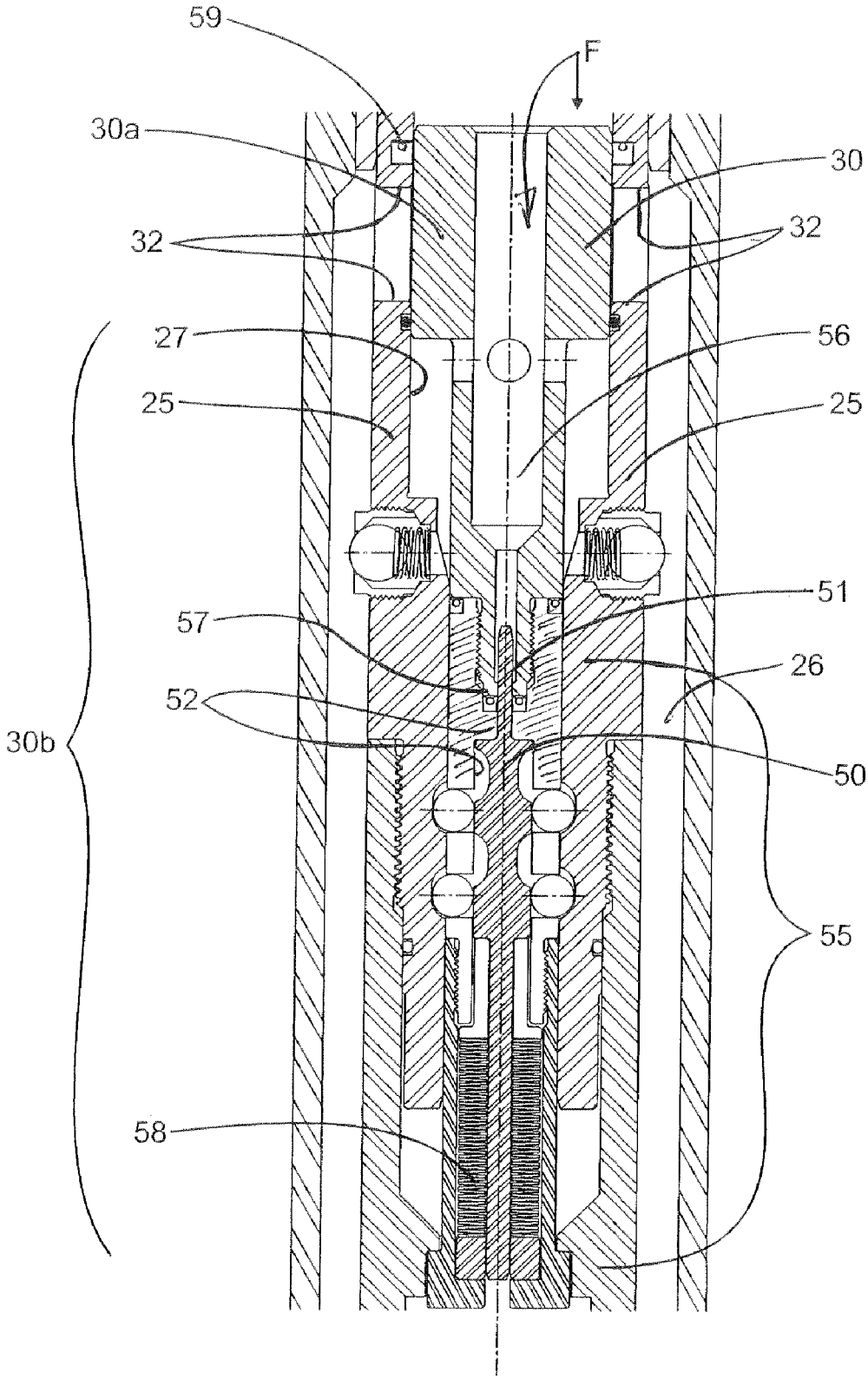
FIG. 4 is a partial cross sectional view of the poppet piston and locked main piston of the tool according to FIG. 2.

As shown in FIGS. 2 and 4, when the valve 24 is closed, the bypass port 32 is blocked by the main piston 30. The downhole end of the sleeve 25 is fit with open downhole ports for enabling exit of the fluid from the bypass annulus 26 through bypass outlet 34 to the injection packer 14. The bypass annulus 26 can be sized with a similar cross-section flow area as the bore 12 of the conveyance string or injection packer to avoid introducing a pressure drop.

The main piston 30 is axially and releasably locked in the closed position until caused to release and open at the fracturing pressure. The main piston 30 is biased to the closed position by a piston spring 45. A locking cylinder or profiled trigger spool 50, pressure-actuated by a poppet piston 51, releasably locks the main piston 30. The trigger spool 50 enables a pressure-actuated snapping open of the main piston 30. As shown the trigger spool is supported in the main piston 30.

Figure 3:
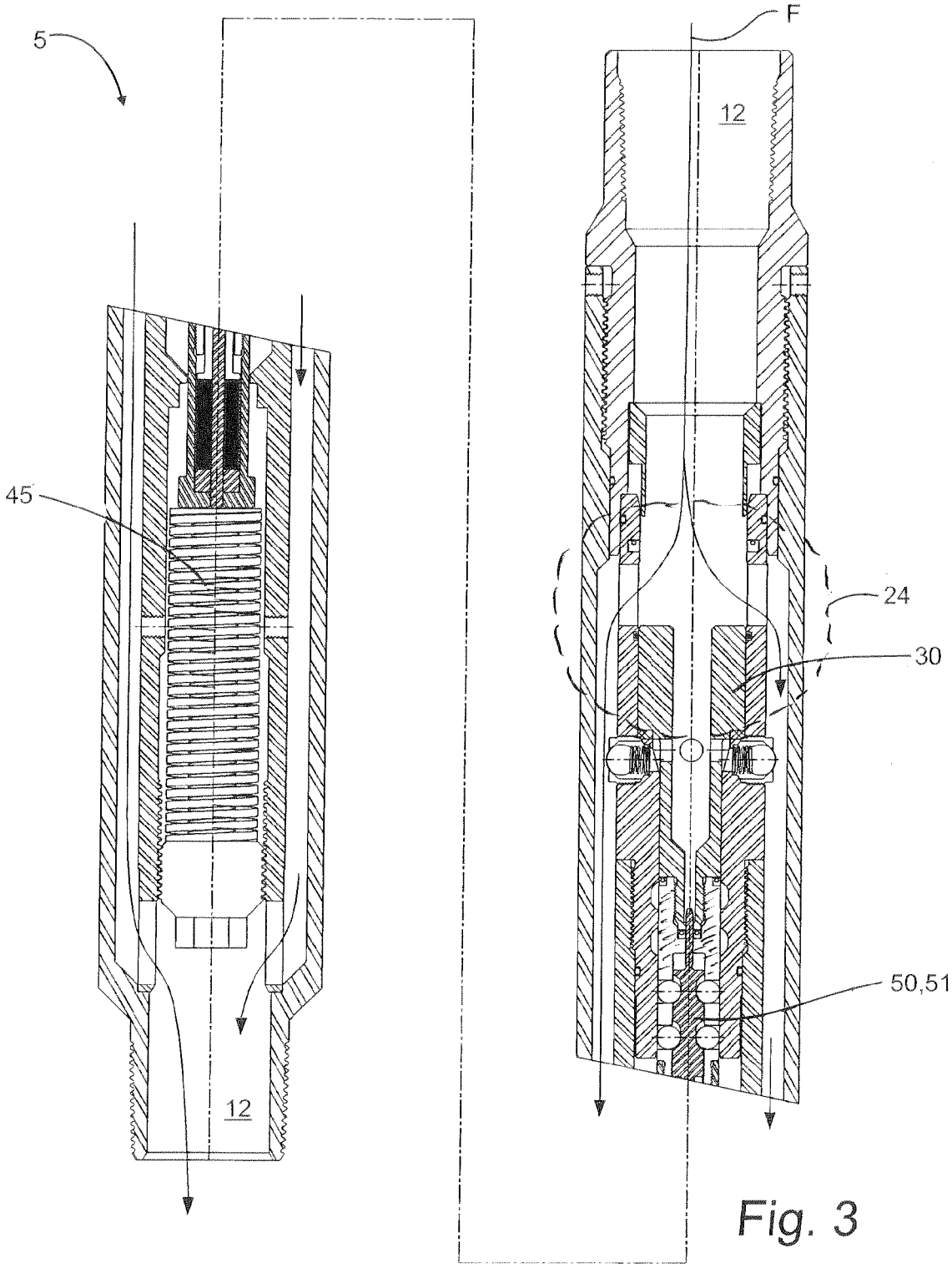
FIG. 3 is a cross-sectional view of an embodiment of the shock tool in the open position.
Figure 5:
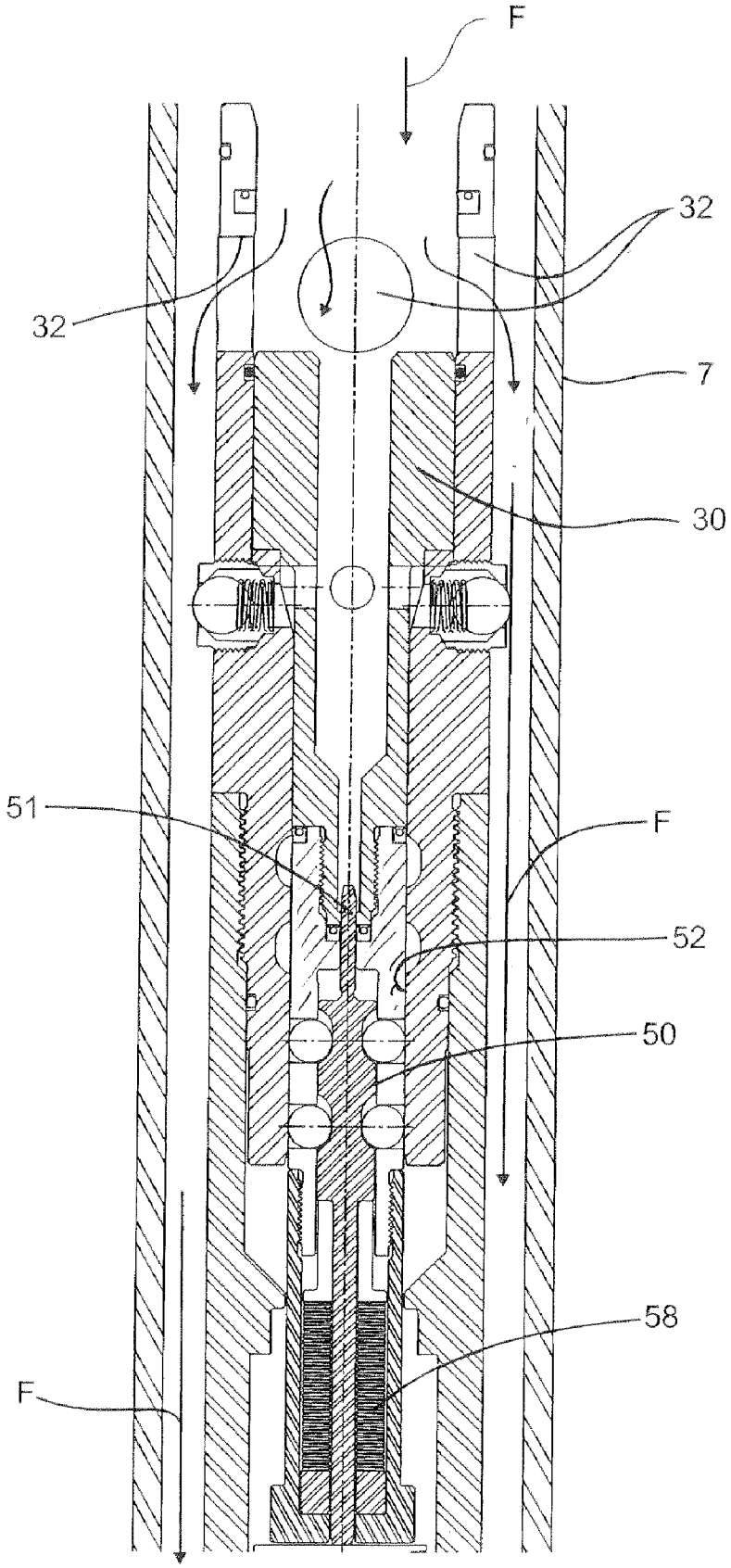
FIG. 5 is a partial cross sectional view of the poppet piston and unlocked main piston of the tool according to FIG. 3.

As shown in FIGS. 3 and 5, when the main piston 30 is unlocked, the main piston can be actuated to the open position when the pressure of the fluid F overcomes the biasing of spring 45 for substantially instantaneous release of the fracturing fluid through the bypass passage 26.

With reference to the detail of the main piston 30 in FIGS. 4 and 5, the poppet-operated valve comprises: the main piston 30 which is movable axially within the piston bore 27 formed in the sleeve 25, a poppet piston 51 movable axially within a poppet piston bore 52 formed in the main piston 30, and the profiled trigger spool 50 releasably engaging between the main piston 30 and the sleeve 25. The bypass port 32 is formed intermediate the piston bore 27. The main piston 30 is actuated by a trigger arrangement 55. The trigger arrangement 55 comprises the poppet piston 51 movable axially within the poppet bore 51 located downhole of the main piston 30.

In one embodiment, the main piston 30 is elongated, having a piston portion 30*a* at an uphole end and having an elongated annular shaft portion 30*b* extending downhole in the sleeve 25. The poppet bore 52 is formed within the shaft portion 30*b* of the main piston 30. A first fluid passage 56 formed axially along the main piston for communication of fluid pressure to the poppet piston 51. The poppet bore houses the poppet piston 51 and, in this embodiment, the trigger spool 50. As shown, the trigger spool 50 happens to act as the poppet piston 51, an uphole pressure face being developed on the trigger spool 50 at a seal 57 to the fluid passage 56. The trigger spool 50 is axially movable within the poppet bore 52. The profiled trigger spool 50 is arranged downhole of the main piston 30 and retains the main piston 30 in the locked position until the poppet piston 51 releases the trigger spool 50.

The poppet piston 51 is biased to the closed position by a poppet spring 58, such as a valve spring. Fluid pressure, such as that conducted through the first passageway 56, acts on the poppet piston 51. The poppet spring 58 is overcome by fluid F at a threshold pressure so as to release the trigger spool 51. The area of the poppet piston 51 at the seal 57, being much smaller than the area of the main piston 30 at seal 59, resisted by the spring 28 biasing, dictates the threshold pressure to unlock the main piston 30. Once unlocked, the greater force on the main piston 30 opens the valve 24 substantially immediately.

Once the fluid pressure acting against the poppet piston 51 overcomes the poppet spring 58, the poppet piston shifts downhole and the profiled trigger spool 50 also shifts downhole within the poppet bore 52, thereby releasing the annular shaft portion 30*b* of the main piston 30 for movement relative to the sleeve 25 and operating the valve 24.

Figure 6C:
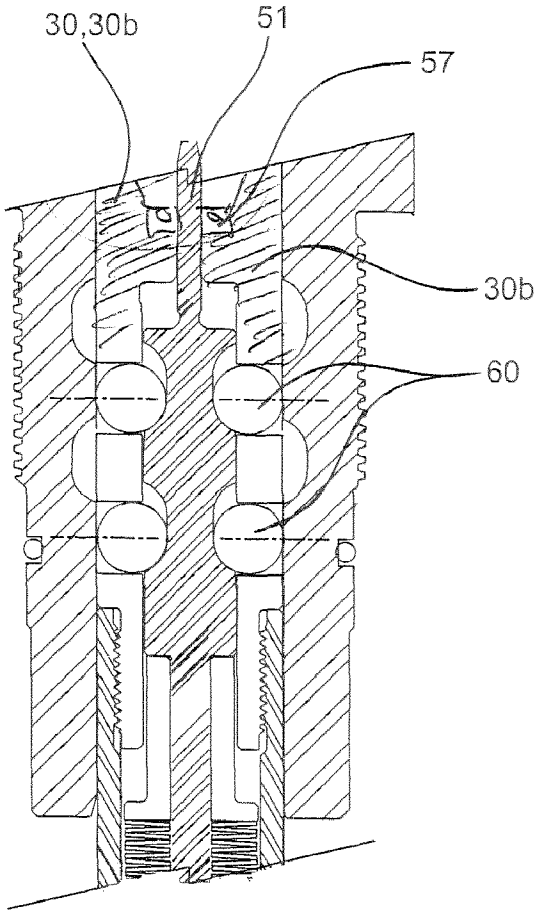
FIGS. 6A, 6B and 6C are sequential partial cross sectional views of the piston, profiled trigger spool in the locked/closed position (see also FIG. 4), an intermediate triggering/closed position, and an unlocked/open position (FIG. 5)
Figure 6B:
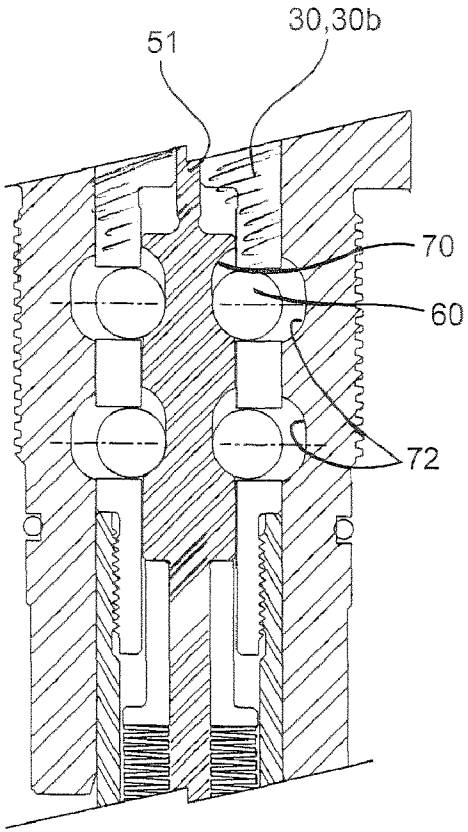
Figure 6A:
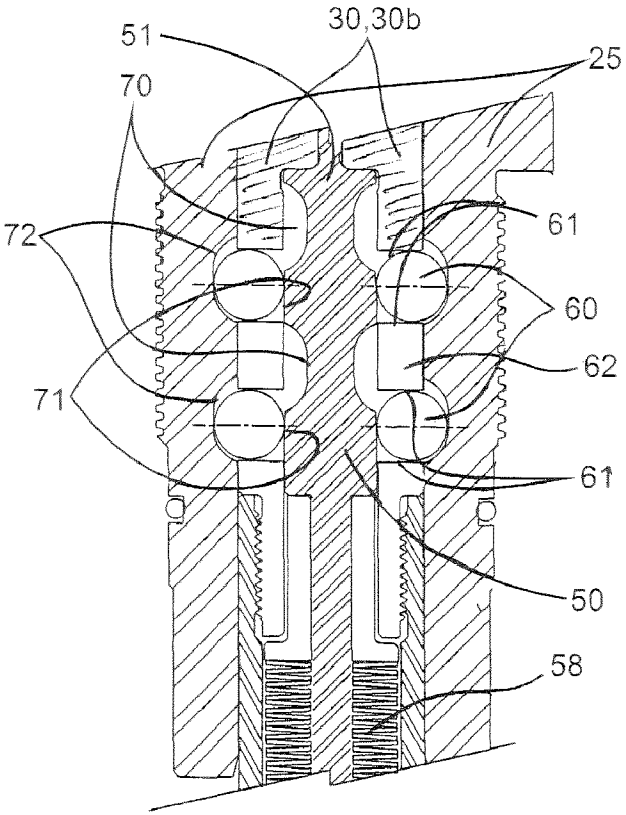
Figure 7:
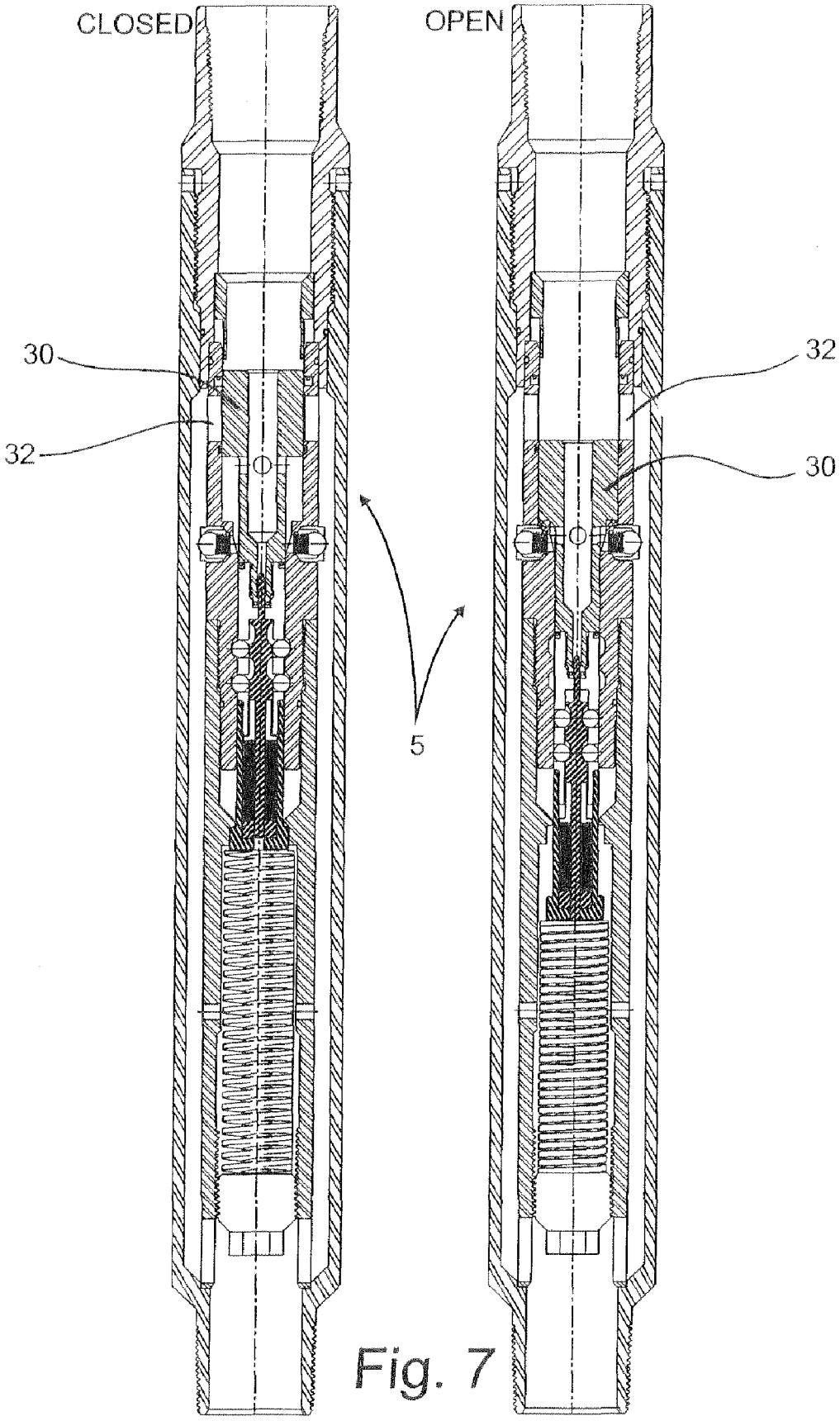
FIG. 7 is a side by side comparison of the tool in the closed and open positions.

With reference also to FIGS. 6A, 6B and 6C, the main piston 30 or the main piston's annular shaft portion 30*b* is releasably locked to the sleeve 25 by one or more locking elements 60, such as spherical balls, supported and movable laterally in one or more corresponding locking ports 61 formed in an annular wall portion 62 of the piston's annular shaft portion 30*b*.

The balls 60 shift between two positions. In one position as shown in FIGS. 2, 4, and 6A, the balls 60 lock the annular shaft portion 30*b* to the sleeve 25 preventing the piston 30 from opening. In the other position as shown in FIGS. 2, 5, and FIGS. 6B and 6C the balls 60 disengage from the sleeve 25 and engage the trigger piston 50 to the annular shaft portion 30*b*.

The trigger spool 50 has one or more axially spaced and circumferentially-extending annular recesses 70 forming locking shoulders 71. The sleeve bore has circumferentially-extending annular recesses 72. The one or more locking ports 61 extend through the annular wall 62. Each locking element or ball 60 has a lateral width sufficient only to straddle between the annular wall 62 and one of the either of the sleeve's or trigger spool's annular recesses 72,70 for alternately releasing for relative axial movement either the main piston 30 from the sleeve 25, or the poppet piston 51 from the main piston 30.

As shown in FIGS. 2, 4, and 6A the valve 24 is closed to accumulate fluid in the conveyance string and also after fracturing fluid has flowed into the formation and the fluid pressure has dropped. As shown in detail in FIG. 6A, when locking ports 61 and balls 60 are aligned to straddle and engage between the annular recesses 72 in the sleeve, and misaligned from the spool's recesses 72, the balls 60 are retained therein by the locking shoulders 71 of the trigger spool 50. The main piston 30 is locked and closed to accumulate fluid F in the conveyance string.

As shown in FIG. 6B, at the threshold release pressure, which can be a release or fracturing pressure, the poppet piston 51 and trigger spool 50 overcome the poppet spring 58 and shift downhole to an intermediate unlocking position, aligning spool's annular recesses 70 with the balls 60 and enabling the balls to shift laterally out of engagement from the sleeve's annular recesses 72. The balls 60 are permitted to disengage from the sleeve's annular recesses 72. The balls 60 straddle and engage between the piston's shaft portion 30*b* and the spool's annular recesses 70. The piston 30 is shown about to open.

As shown in FIGS. 3, 5, and 6C, the main piston 30 is unlocked and released from the sleeve 25 and is moved to shifted axially for opening the bypass port 32.

In this arrangement, at low fluid pressures, the reverse sequence occurs from FIG. 6C through FIGS. 6B and 6A, wherein the main piston 30, which is free to move axially, first biases through the intermediate position of FIG. 6B again. The balls 60 can realign with the annular recesses 72 in the sleeve 25. With the pressure on the poppet piston 51 having dissipated, the poppet spring 58 biases the poppet piston 51 and trigger spool 50 uphole to shift the balls 60 back into engagement with the sleeve's annular recesses 72 and thereby releasing the trigger spool 50 and poppet piston 51 to reset, locking the main piston 30 once again to the sleeve 25.

Figure 8A:
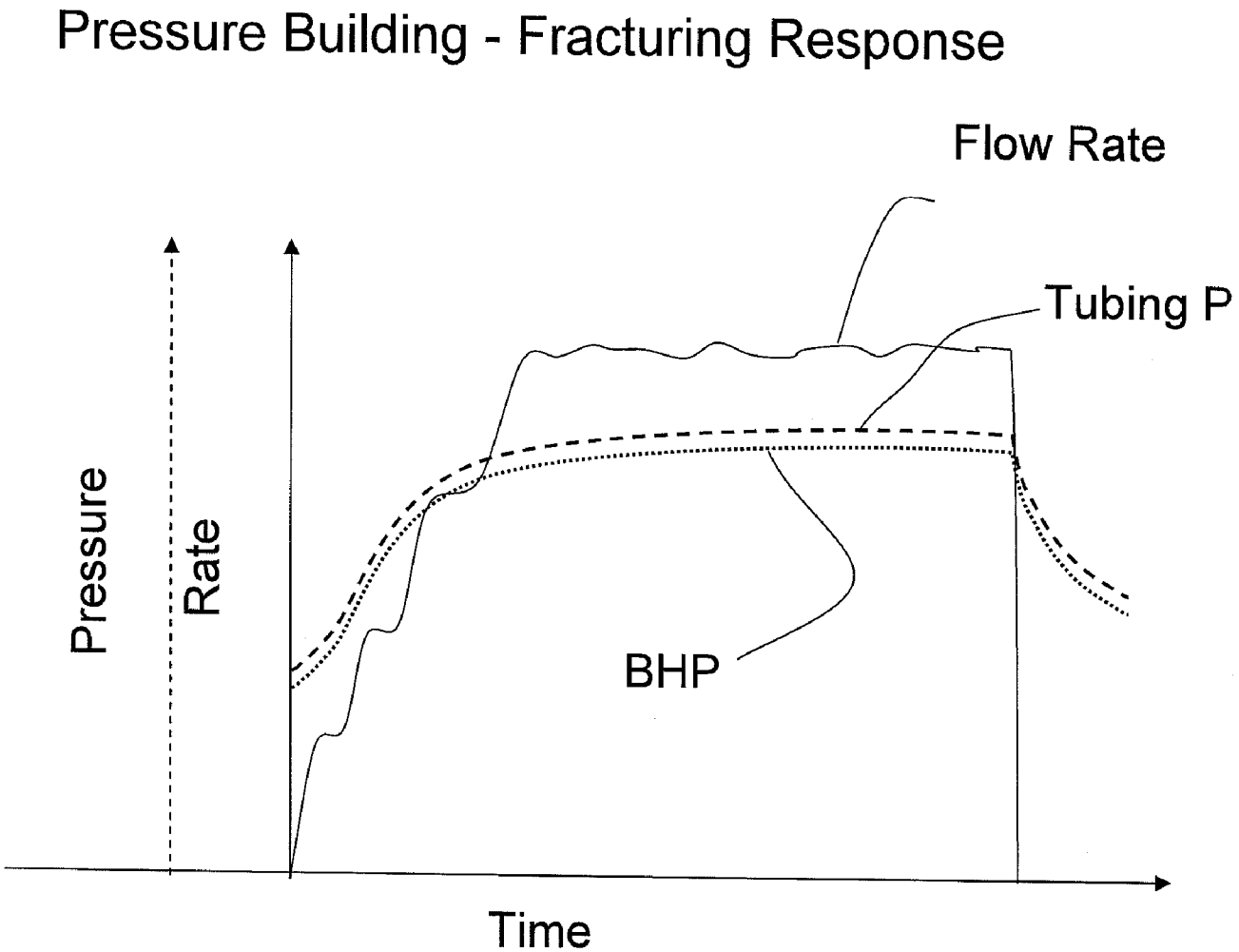
Fig. 8A Prior Art
FIG. 8A (PRIOR ART) is a chart of the tubing pressure, flow rate and formation bottom hole pressure response of conventional fracturing.

As shown in FIG. 8A, and in current conventional operations (PRIOR ART), a typical fracturing operation with gaseous fluids, such as nitrogen, comprises pumping gas downhole to the formation at a rate which exceeds the loss of fluid into the formation. Thus tubing pressure and bottom hole pressure increase in unison. Typically, at a certain pressure, the formation fractures and fluid rates are usually increased for a period to accommodate increased flow into the fractures. This approach has not been particularly successful with certain formations.

Figure 8B:
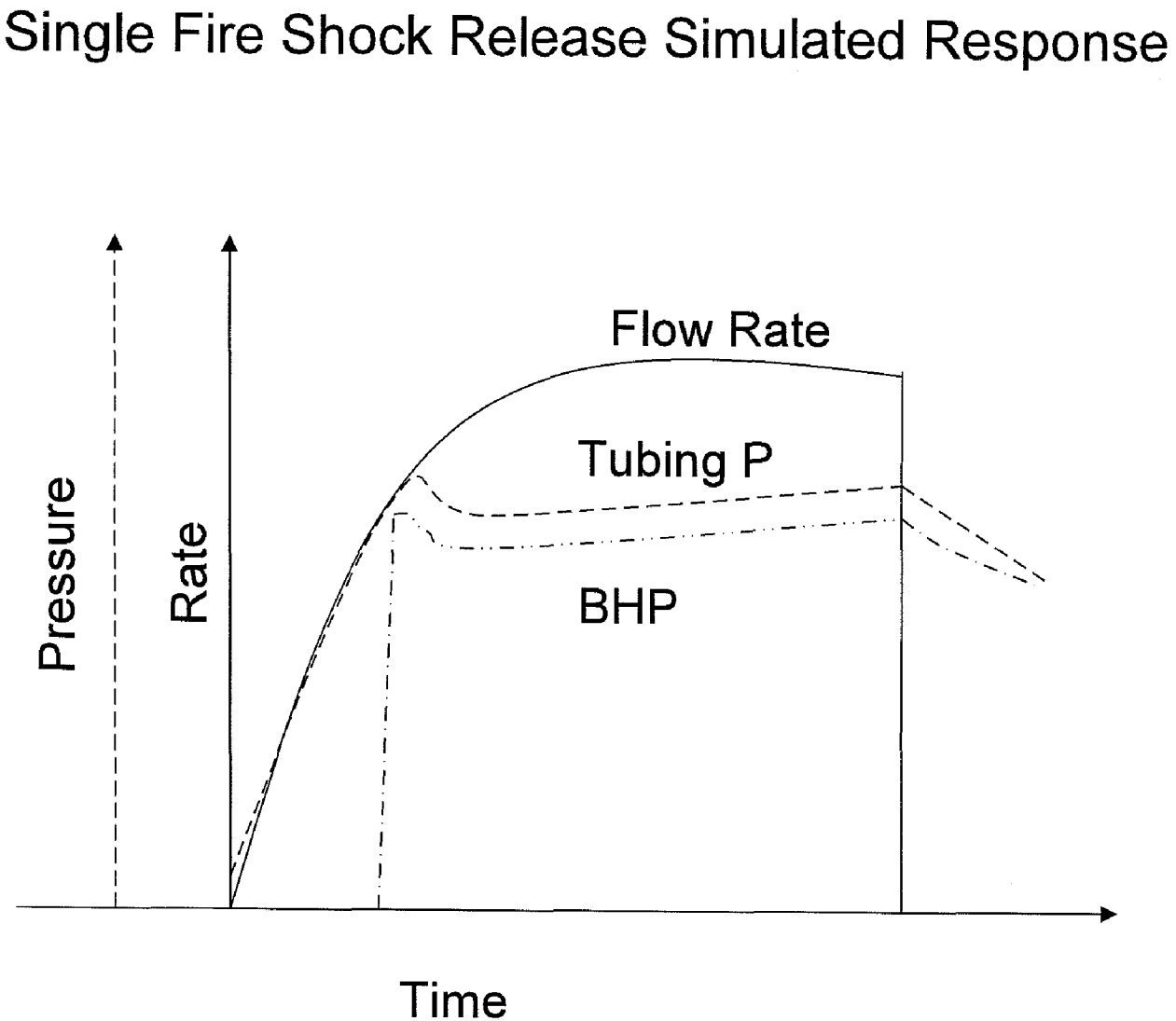
FIGS. 8B and 8C are simulated charts of the tubing pressure, flow rate and formation bottom hole pressure response using two embodiments of the invention using a accumulated shock release of fracturing fluid with full pressure release, and using cyclical shock fracturing, in contradistinction from the prior art of FIG. 8A.
Figure 8C:
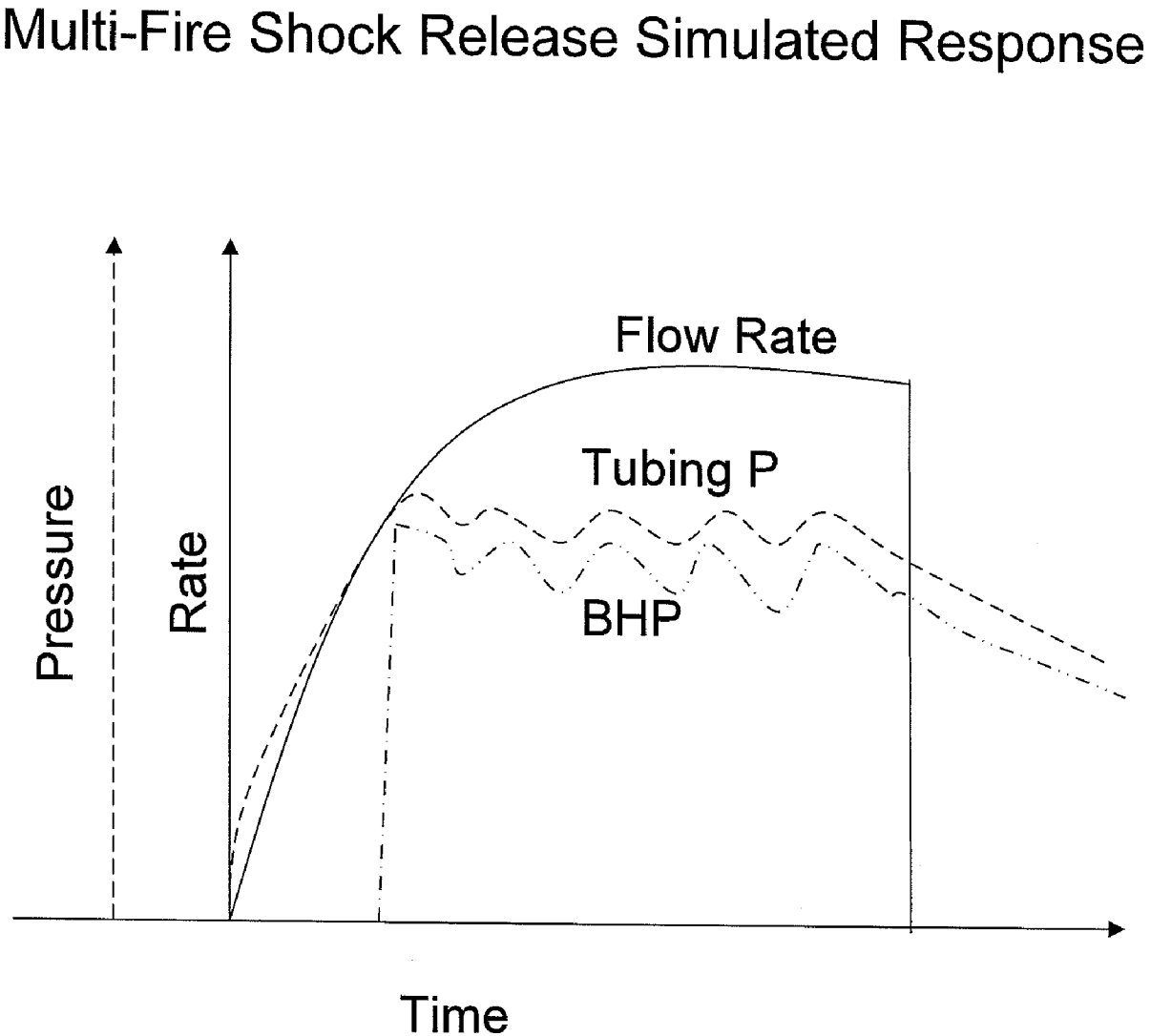

With reference to FIGS. 8B and 8C, in embodiments of the present invention, apparatus such as the shock tool enable a new methodology of operation which comprises pumping fracturing fluid, such as gaseous nitrogen, down coiled tubing to the shock tool for building or accumulating pressure to a pre-determined threshold pressure which is usually tuned to the formation, including formation depth and lithology. The bottom hole pressure for the isolated zone remains at formation pressure as the tubing pressure builds.

At the threshold pressure, the shock tool opens and there is a sudden release of the fracturing fluid to impact the formation. Substantially immediately, the bottom hole pressure rises or equilibrates to substantially the same as the accumulated tubing pressure, applying the full fracturing pressure to the formation. It is believed that a coal bed methane formation is particularly favourably affected by a shock application of the fracturing fluid.

As shown in FIG. 8B, in a single fire operation, one can continue to flow fracturing fluid through the valve and into the formation for a period and permit the pressure to dissipate.

Alternatively, as shown in FIG. 8C, in a multi-fire operation, one can cycle the pressure applied to the formation. Cycling of the pressure could be advantageous for some formations. Cycling approaches can include a nearly complete dissipation of fluid pressure before the shock tool closes for re-accumulating fluid pressure for one or more subsequent shock fracturing operations. Alternatively, a series of lesser pressure differential cycles could be applied, wherein the shock tool opens, some pressure is dissipated, pressure is accumulated and released again in rapid cycles.

Due to the compressibility of gases, fracturing fluids such as nitrogen are advantageously applied using the shock methodology.

Figure 9:
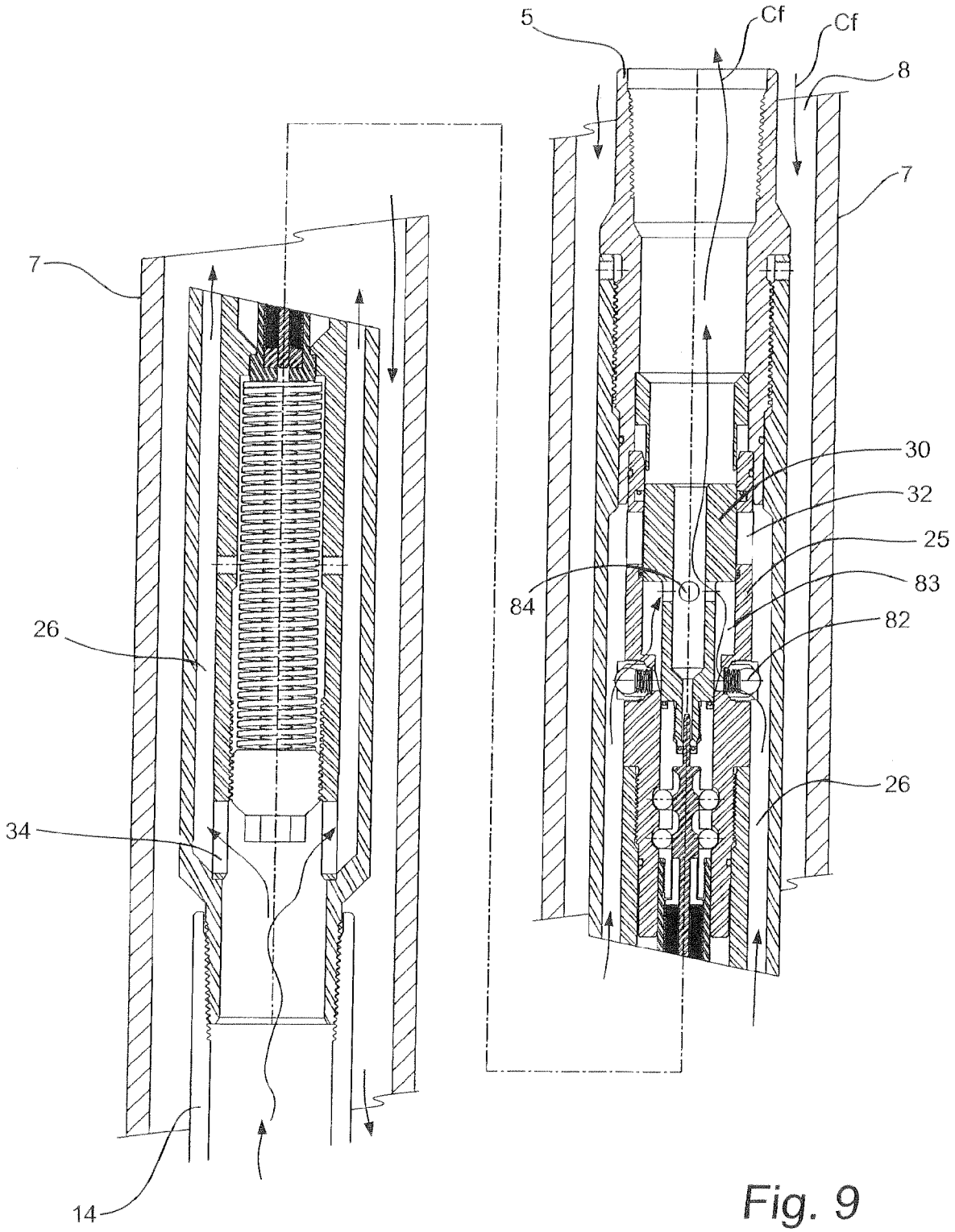
FIG. 9 is a cross-sectional view of the embodiment of the shock tool according to FIG. 2, in the closed position, while running in, and showing casing annulus fluid flow being circulated back uphole through the relief valve of the shock tool and the bore of the conveyance string.

With reference to FIGS. 9 and 1, one can avoid pressure build up at the injection packer 14 while running in the tool assembly 6 which, in particular, can pre-set the uphole seal or cups 15 and cause damage thereto before they are positioned to isolate the zone of interest. A situation can arise in which, as the injection packer 14 is run in, existing fluid downhole of the downhole cups 16 can flow in the annulus 8 formed between the tool assembly 6 and the wellbore or casing 7, however as the uphole cups 15 are oriented to seal the other direction, they can be forced to expand prematurely and engage the wellbore casing 7.

As shown in FIG. 9, in one embodiment, while running the tool assembly 6 to the formation, circulating fluid CF, which can conveniently be the same fluid as the fracturing fluid, is injected into the annulus 61 and circulated uphole through the injection packer 14 and to the conveyance string for return to surface. The circulation fluid CF flows into the injection packer 14 uphole through the injection port 18, then uphole through the shock tool 5.

Circulation fluid CF flowing downhole past the uphole cups 16 separates them from the casing 15 to avoid pre-activation and wear. The sleeve 25 of the shock tool 5 is fit with one or more pressure relief valves 82 positioned downhole of the main piston 30. Circulating fluid CF flowing uphole to the tool 5, such as from the injection ports 18, flows into the bypass annulus 26 through the bypass outlet 34. The main piston 30 is in the closed position. Accordingly, circulating fluid flows from the bypass passage 26 and through the pressure relief valves 82 and into an annular chamber 83 formed between the main piston 30 and the sleeve 25. The main piston 30 has a flow port 84 formed therethrough to the fluid passageway 56 and into the bore 12 of the conveyance string or tubing. The one-way relief valves 82 are ineffective during the normal accumulation and shock release modes of the shock tool 5.

The predetermined fracturing pressure accumulated at the shock tool can be about the fracture gradient of the formation or the overburden strength of about 20 kPa/meter of depth or greater. For example, fracturing fluid pressure for a zone depth of about 600 meters could be initially set for 12 to 25 MPa.

The embodiments of the invention for which an exclusive property or privilege is claimed are defined as follows:

1. A method for fracturing subterranean formations penetrated by a wellbore comprising:

accessing the formation with a conveyance string having a bore and extending downhole through the wellbore for conveying a tool to the formation;

isolating a zone with the tool, the tool having an uphole seal and a downhole seal spaced uphole and downhole of the isolated zone;

closing the bore of the conveyance string at a valve at the tool, the valve having a main piston which is biased to close the valve and is pressure-actuated to open the valve, the closing of the bore accumulating a gaseous fracturing fluid along an entirety of the conveyance string or wellbore uphole of the valve, the gaseous fracturing fluid being accumulated to a threshold pressure;

opening the bore of the conveyance string at the valve at the threshold pressure, the opening of the bore further comprising pressure-actuating a poppet piston at the threshold pressure for triggering unlocking of the main piston, pressure-actuating the unlocked main piston to overcome the main piston biasing for opening the valve so as to communicate with the isolated zone for releasing the accumulated gaseous fracturing fluid, from along substantially the entirety of the conveyance string or the wellbore uphole of the valve, to the isolated zone to shock fracture the formation; and closing the valve comprising biasing the main piston closed at the resetting pressure; and resetting the poppet piston with the main piston closed for locking the main piston closed.

2. The method of claim 1 further comprising, after releasing the fracturing fluid:

closing the fracturing fluid from communication with the isolated zone;

re-accumulating fracturing fluid; and releasing the fracturing fluid to the isolated zone so as to shock fracture the formation.

3. The method of claim 1 further comprising:

isolating a new zone in the subterranean formation;

accumulating fracturing fluid to the threshold pressure; and releasing the fracturing fluid to the new isolated zone and shock fracture the formation.

4. The method of claim 1 wherein:

the opening of the bore of the conveyance string at the valve further comprises releasing the accumulated gaseous fracturing fluid through a port in the tool to communicate with the isolated zone and shock fracture the formation.

5. A tool assembly for shock fracturing a subterranean formation penetrated by a wellbore, the tool assembly conveyed on a conveyance string positioned downhole in the wellbore at a position adjacent the formation and forming an annulus therebetween which is in fluid communication with the formation, the tool assembly comprising:

an injection tool having an uphole seal and a downhole seal adapted for isolating the annulus uphole and downhole of a zone in the formation, an injection bore at an inlet end uphole of the uphole seal, and an injection port communicating between the bore and the isolated zone; and a shock tool having an inlet and a bore in communication with the injection bore, the shock tool bore having a valve with a pressure-actuated poppet piston biased for locking the valve in a closed position and pressure-actuated for unlocking the valve fit to the inlet, wherein gaseous fracturing fluid is accumulated along an entirety of the conveyance string or the wellbore uphole of the inlet at a fluid pressure when the valve is locked in its closed position, and when the fluid pressure reaches a threshold pressure, the poppet piston is pressure-actuated for unlocking the valve for triggering pressure-actuated opening of the valve for releasing the accumulated fracturing fluid from substantially the entirety of the conveyance string or the wellbore uphole of the inlet through the shock tool to the injection port for shock fracturing the formation, and when the fluid pressure reaches a resetting pressure below the threshold pressure, the valve is biased to close and the poppet piston is biased to lock the valve in its closed position.

6. The tool assembly of claim 5 wherein:

the inlet of the shock tool is in communication with the wellbore uphole of the uphole seal; and fracturing fluid is accumulated in the wellbore.

7. The tool assembly of claim 5 wherein:

the shock tool is suspended from the conveyance string extending downhole through the wellbore;

the conveyance string having a bore in communication with the bore of the shock tool at the inlet; and the fracturing fluid is accumulated in the bore of the conveyance string uphole of the inlet of the shock tool.

8. The tool assembly of claim 5 wherein the valve further comprises a main piston movable axially in a piston bore having a discharge port being formed along the piston bore, the main piston being biased for blocking the discharge port by the main piston for closing the valve and pressure-actuable for shifting the main piston to unblock the discharge port for opening the valve.

9. The tool assembly of claim 8 further comprising a sleeve fit to a tubular body for forming a bypass annulus therebetween, the main piston being axially movable in the sleeve for opening and closing the discharge port being formed through the sleeve, the bypass annulus being in communication with the injection port.

10. The tool assembly of claim 9 further wherein:

the poppet piston is movable axially in a poppet bore formed in the main piston, the poppet piston further comprising a trigger spool having one or more axially spaced annular release recesses;

the sleeve has one or more axially spaced locking recesses formed therein; and the main piston has one or more locking ports extending between the poppet bore adjacent the trigger spool and the sleeve, the poppet further comprising one or more locking elements movable in the locking ports, alternately, when the locking ports are misaligned from the trigger spool's release recesses, the locking elements straddle between the main piston and the sleeve's annular locking recesses, wherein the main piston is locked and closed, and when the locking elements align with the trigger spool's release recesses, the locking elements straddle between the locking ports and the trigger spool's release recesses, wherein the main piston is unlocked and released to open.

11. The tool assembly of claim 10 wherein the poppet piston is pressure-actuable at the threshold pressure to align the trigger piston's release recesses with the locking ports to unlock the main piston.

12. The tool assembly of claim 10 wherein when the main piston is unlocked, the main piston is pressure-actuated to open the discharge port.

13. The tool assembly of claim 10 wherein when the main piston is biased to close at the resetting pressure, the main piston moves axially to align the locking ports with the sleeve's locking recesses to reset the trigger spool and poppet piston and lock the main piston.

* * * * *